US006164978A

United States Patent [19]

McHugh et al.

[11] Patent Number: 6,164,978

[45] Date of Patent: Dec. 26, 2000

[54] LAND GRID ARRAY CONNECTOR

[75] Inventors: Robert G. McHugh, Evergreen, Colo.; Nick Lin, Hsin-Chuang, Taiwan; Jaô-Min Wang, Hsin-Dan, Taiwan; Shih-Wei Hsiao, Tu-Chen, Taiwan

[73] Assignee: Hon Hai Precision Ind. Co., Ltd., Taipei Hsien, Taiwan

[21] Appl. No.: 09/415,756

[22] Filed: Oct. 8, 1999

[51] Int. Cl.[7] ..... H01R 9/09

[52] U.S. Cl. ..... 439/66

[58] Field of Search ..... 439/66, 71

[56] References Cited

U.S. PATENT DOCUMENTS 4,647,124 3/1987 Kandybowski ..... 439/71

5,653,598 8/1997 Grabbe ..... 439/66

*Primary Examiner*—Brian Sircus
*Assistant Examiner*—Phuong K T Dinh
*Attorney, Agent, or Firm*—Wei Te Chung

[57] ABSTRACT

A contact comprises an upper beam and a lower beam both of which are connected by two side plates at two ends thereof. An upper spring arm extends from the upper beam and a lower spring arm extends from the lower beam. The upper spring arm having a contacting section substantially located at a highest position of the contact. The lower spring arm has a soldering tail substantially located at a lowest position of the contact. When the side plates and the soldering tail are fixed in position and the contacting section of the upper spring arm is urged by an external force, the upper beam will be twisted for a predetermined angle to transmit a tension to the contacting section.

15 Claims, 7 Drawing Sheets

LAND GRID ARRAY CONNECTOR

BACKGROUND OF THE INVENTION

1. Field of The Invention

The present invention relates to a land grid array (LGA) connector for electrically connecting a CPU to a printed circuit board, especially one LGA connector having contacts each of which has an upper section resiliently urged to the CPU and a lower section surface mounted to the printed circuit board.

2. The Prior Art

Land grid array (LGA) connectors are commonly used with IC packages and do not require soldering procedures during engagement between the LGA connector and a related printed circuit board (PCB). Normally, an LGA assembly includes an IC package having a plurality of flat contact pads formed on a bottom surface thereof, a connector having an insulative housing and defining a plurality of passageways therethrough, and a plurality of conductive contacts received in the passageways of the connector. Fastening means consisting of a top plate positioned on a top surface of the IC package, a bottom plate positioned on a bottom surface of the PCB, and a plurality of sets of aligned holes defined through the PCB, the top plate and the bottom plate are used to configure the assembly. Each set of aligned holes receives a screw therein which engages with a washer and a nut thereby sandwiching the LGA assembly between the top and bottom plates of the fastening means.

U.S. Pat. No. 5,653,598 discloses an electrical contact for use in a connector 30 between mutually opposed electrical interfaces 40, 99 such as contact pads respectively formed on an IC package 2 and a printed circuit board 9, as shown in FIG. 10. The conventional contact comprises a generally planar contact body 10 having first and second major faces 110, 120. The body includes a pair of spaced apart spring arms 140, 150 connected by a resilient bight portion 160. The spring arms 140, 150 each have a free end with an outwardly facing edge forming a contact nose 17, 18 for engaging with the corresponding interface 40, 99. Shorting sections 19, 20 generally extend toward each other from the free ends and are offset such that, upon deflection of the spring arms 140, 150 toward each other, the shorting sections 19, 20 overlap and the first major face 110 engages the second major face 120. Thus, a shortened electrical path is formed between the contact noses 17, 18 when the package 2 is urged against the connector 30.

The electrical interface 40 of the IC package 2 may not be able to properly abut against the contact nose 17 of the contact body 10 due to misalignment when the IC package 2 and the printed circuit board 9 are forced to sandwich the connector 30 by a clip or screws.

Moreover, the shorting sections 19, 20 may not properly contact each other due to unwanted lateral deflection thereof when the bight of the contact is deformed. Although the inner wall of the passageway receiving the contact may be used to limit the lateral deflection of the shorting sections 19, 20, unwanted scraping of the shorting sections 19, 20 against the inner wall of the passageway may occur thereby adversely affecting the proper overlap of the two shorting sections 19, 20. Proper overlap and engagement of the two shorting sections 19, 20 is difficult to achieve with this structure. Moreover, an additional contact resistance exists between the shorting sections 19, 20 thereby adversely affecting the signal transmission.

Additionally, the conventional LGA connector is in advance fixed in a motherboard via screws in a pre-assembly procedure. In a final assembly procedure, the screws have to be released first and then fastened for urging the CPU to the LGA connector. Therefore, in the total assembly procedure, the screws have to be fastened, released, and fastened again. This is cumbersome and not accepted by most mother board manufacturers. It is requisite to provide a new LGA connector for solving the above problems.

SUMMARY OF THE INVENTION

The primary purpose of the present invention is to provide a new LGA contact which has a soldering tail for connection to a printed circuit board in advance and a resilient contacting section for connection to a CPU via urging.

Another purpose of the present invention is to provide a new LGA connector which has new LGA contacts each of which may be partially surface mounted to a printed circuit board and partially connected to a CPU by urging.

In accordance with one aspect of the present invention, a contact comprises an upper beam and a lower beam both of which are connected by two side plates at two ends thereof. An upper spring arm extends from the upper beam and a lower spring arm extends from the lower beam. The upper spring arm having a contacting section substantially located at a highest position of the contact. The lower spring arm has a soldering tail substantially located at a lowest position of the contact. When the side plates and the soldering tail are fixed in position and the contacting section of the upper spring arm is urged by an external force, the upper beam will be twisted for a predetermined angle to transmit a tension to the contacting section.

In accordance with another aspect of the present invention, a land grid array connector comprises an insulative housing having a plurality of passageways defined therein, each passageway having a longitudinal wide hole and a lateral narrow hole communicating with and perpendicular to the longitudinal wide hole. A plurality bf contacts each are received in one of the passageways. Each contact comprises an upper beam and a lower beam both of which are connected by two side plates at two ends thereof. An upper spring arm extends from the upper beam and a lower spring arm extends from the lower beam. The upper spring arm has a contacting section substantially located at a highest position of the contact. The lower spring arm has a soldering tail substantially located at a lowest position of the contact. The side plates are firmly fixed in the lateral narrow hole. The soldering tail exposes to external from the longitudinal wide hole for being surface mounted to an external printed circuit board. The contacting section extends out of the longitudinal wide hole adapted to be urged by an external CPU package.

DETAILED DESCRIPTION OF THE PREFERRED EMBODIMENT

Figure 1:
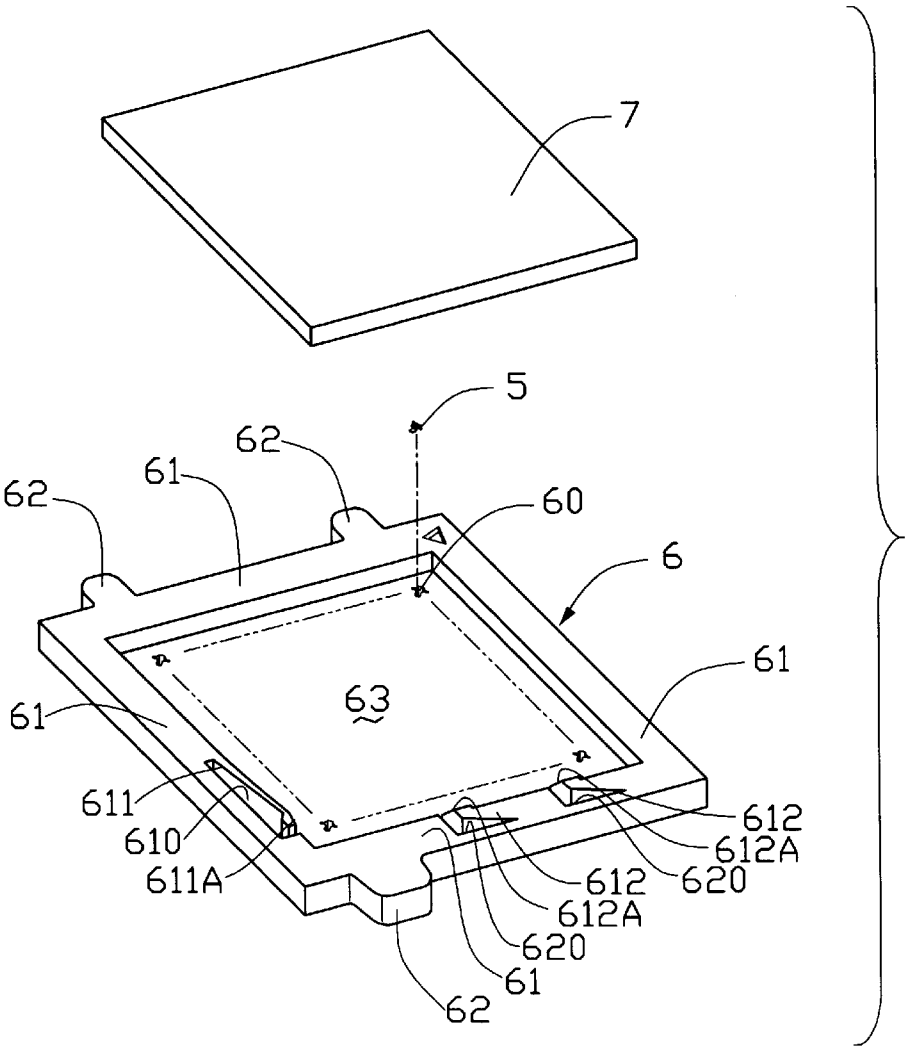
FIG. 1 is an LGA socket in accordance with the present invention for receiving a CPU package.
Figure 2:
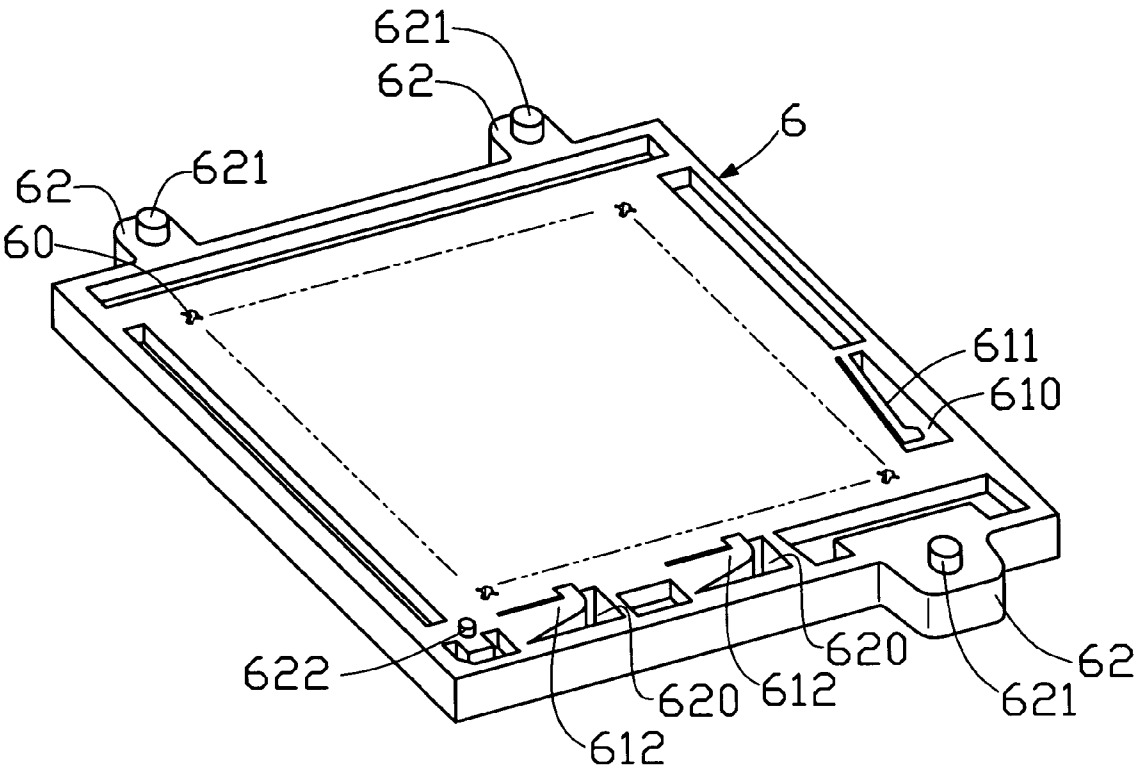
FIG. 2 is a perspective view of the LGA socket of FIG. 1 taken from,a different angle.

Referring to FIGS. 1 and 2, an LGA connector in accordance with the present invention comprises an insulative housing 6 defining a plurality of passageways 60 therein for receiving LGA contacts 5. The housing 6 is substantially a body having four raised sides 61 and a central cavity 63 defined between the four raised sides 61 and sized to receive an external electrical device such as a CPU package 7. The passageways 60 are defined through a bottom surface of the central cavity 63. The LGA contact 5 is received in each of the passageways 60. A first resilient arm 611 is formed in one of the four raised sides 61 and capable of deformation in a first space 610 defined in the raised side 61. Two second resilient arms 612 are formed in another raised side 61 adjacent to the one in which the first resilient arm 611 is formed. The second resilient arm 612 is capable of deformation in a second space 620 defined in the raised side 61. The first resilient arm 611 and the second resilient arms 612 each have a chamfer surface 611A, 612A respectively formed in an upper edge thereof for guiding insertion of the CPU package 7 to the central cavity 63. The CPU package 7 is fixed in the cavity 63 by normal force originated from the deformation of the resilient arms 611, 612. Three ears 62 extend from opposite raised sides 61 near three corner of the housing 6 and each ear 62 has a post 621 extending downward for fixing within openings (not shown) of a printed circuit board 9 (see FIG. 6). Similarly, an additional post 622 extending from the bottom of the housing 6 near another corner thereof for fixing within another opening (not shown) of the printed circuit board 9.

Figure 4:
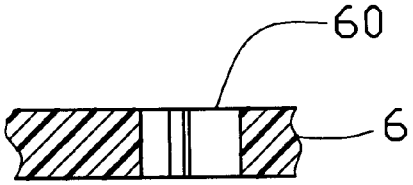
FIG. 4 is a cross-sectional view taken from line 4—4 of FIG. 3.
Figure 3:
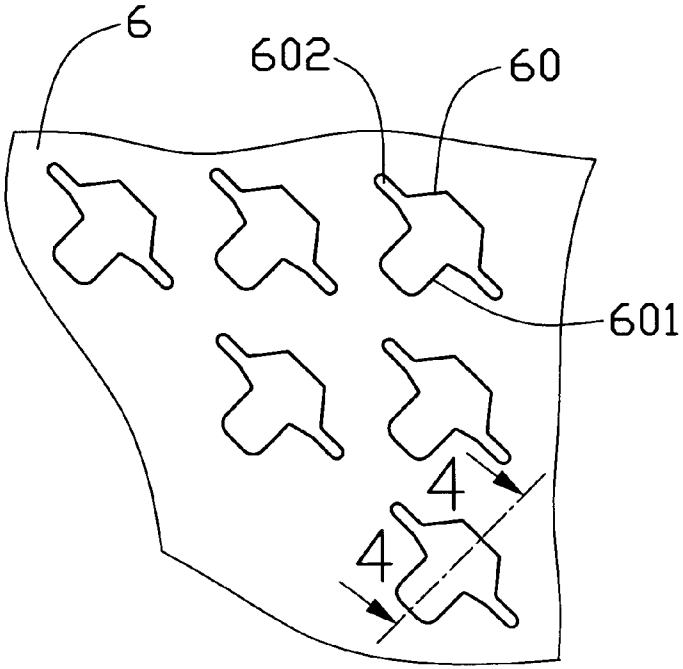
FIG. 3 is an enlarged top view of several passageways of FIG. 1.

Referring to FIGS. 3 and 4, each passageway 60 has a longitudinal wide hole 601 and a lateral narrow hole 602 communicating with and perpendicular to the longitudinal wide hole 601. The lateral narrow hole 602 is diverged to the longitudinal wide hole 601, therefore the end portions of the lateral narrow hole 601 are narrower than the other portions thereof.

Figure 5:
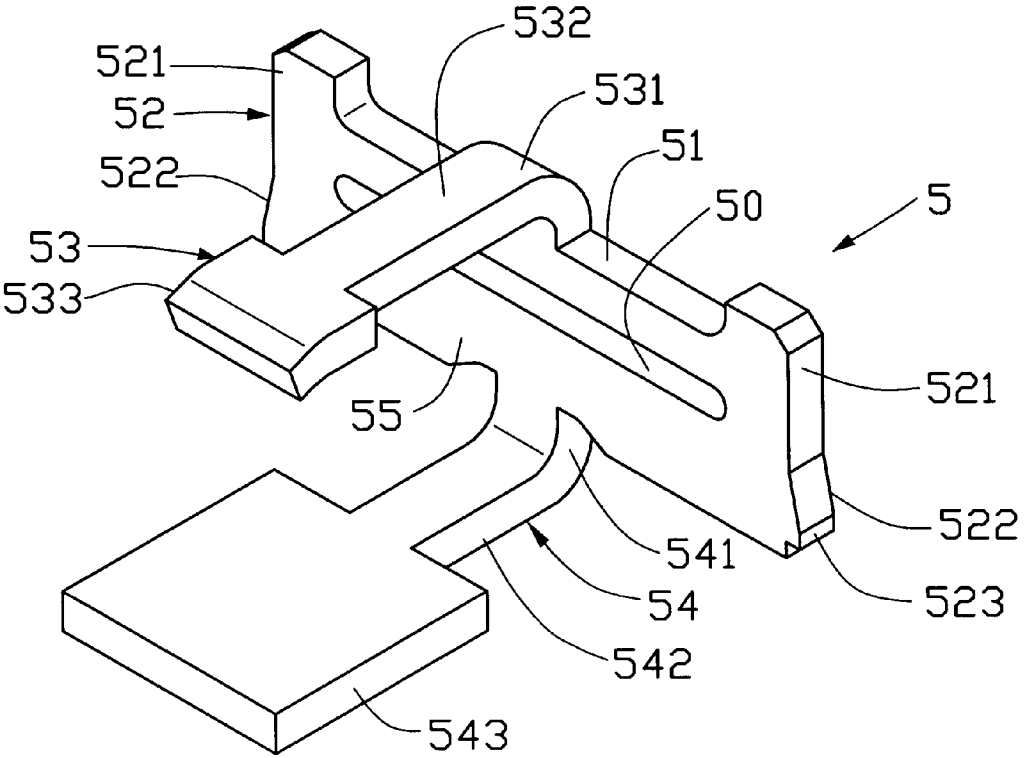
FIG. 5 is an enlarged perspective view of the contact shown in FIG. 1.
Figure 6:
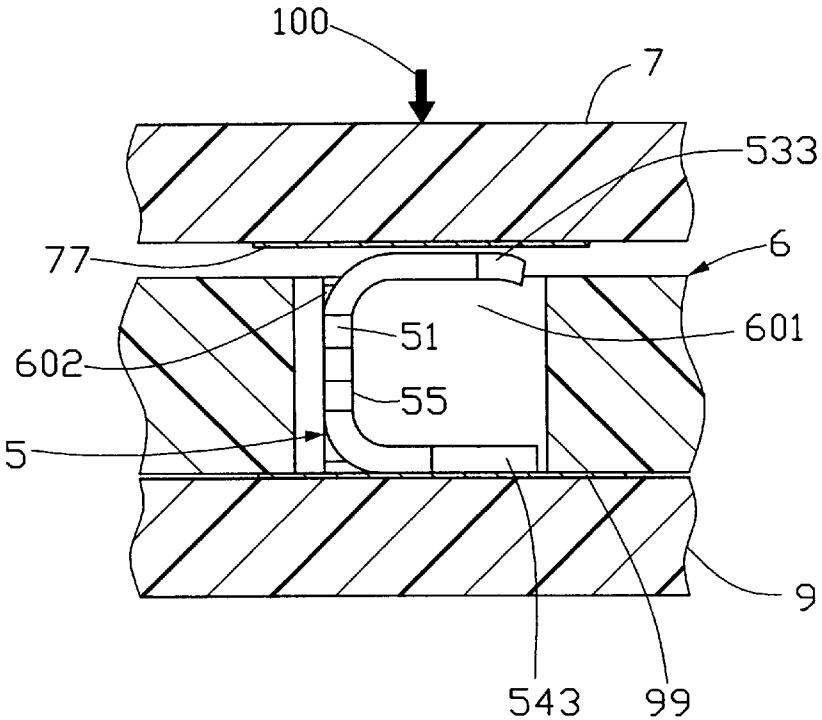
FIG. 6 is a schematic view showing a portion of the socket and two electrical devices before sandwiching the socket.

Referring to FIGS. 5 and 6, the CPU package 7 has a plurality of contact pads 77 (only one is shown for simplicity) and the printed circuit board 9 also has aplurality of contact pads 99 (only one is shown)and each pair of contact pads 77, 99 are arranged to register with each other when the CPU package 7 and the printed circuit board 9 sandwich the connector. The contact 5 comprises an upper beam 51, a lower beam 55, and two side plates 52 integrally connected to two ends of the upper beam 51 and the lower beam 55, thereby defining a slot 50 therebetween. It should be noted that the lower beam 55 may be made shorter and only connected to one side plate 52 while still not affecting the function of the contact 5.

Each side plate 52 is perpendicular to the upper beam 51 and the lower beam 55. An upper spring arm 53 extends from a center section of the upper beam 51 and a lower spring arm 54 extends from a center section of the lower beam 55. Each side plate 52 has a straight upper edge 521, a tapered lower edge 522 connected to the straight upper edge 521, and a barb 523 formed at a bottom end of the tapered lower edge 522 for firmly engaging with the inner wall of the passageway 60. The tapered lower edges 522 are diverged downward so that the contact 5 can only be loaded into the passageway from a bottom direction. The straight upper edges 521 and the tapered edges 522 facilitate the load-in of the contact 5 into the passageway 60. The barbs 523 prevent the contact 5 from leaving the passageway 60.

The upper spring arm 53 has a first curved section 531 extending from the upper beam 51, a first straight section 532 connected to the first curved section 531, and a contacting section 533 connected to the first straight section 532. The contacting section 533 is located out-of the passageway 60 before an urge from the CPU chip 7. The lower spring arm 54 has a second curved section 541 extending from the lower beam 55, a second straight section 542 connected to the second curved section 541, and a soldering tail 543 connected to the second straight section 542. The soldering tail 543 is in advance soldered to the contact pad 99 of the printed circuit board 9. The contacting section 533 extends out of the passageway 60 and registers with a corresponding contact pad 77 of the CPU package 7.

After the connector has been soldered on the printed circuit board 9 and the CPU package 7 has been received in the central cavity 63 of the connector, each contact pad 77 of the CPU package 7 will register with the contacting section 533 of a corresponding contact 5 as shown in FIG. 6.

Figure 7:
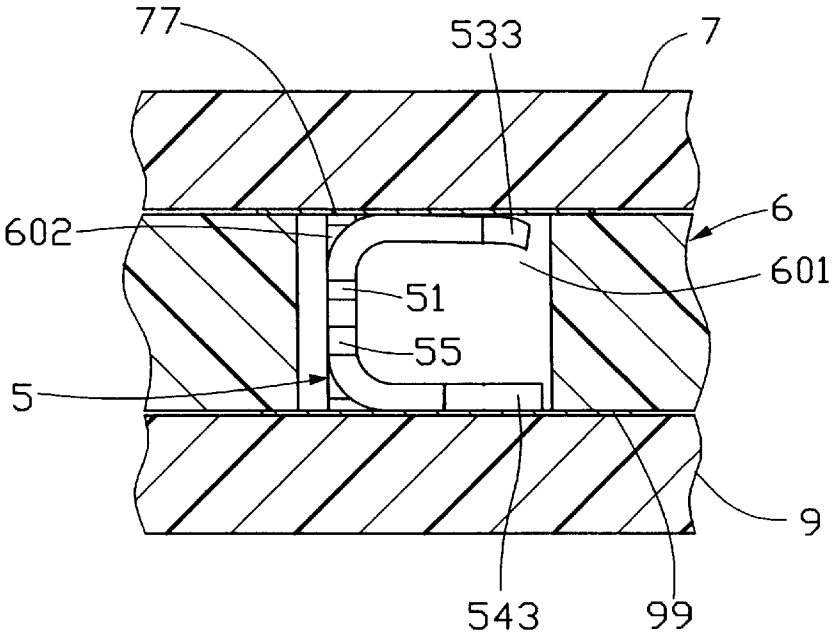
FIG. 7 is a schematic view showing a portion of the socket and two electrical devices sandwiching the socket.

Also referring to FIG. 7, the CPU package 7 is then urged to the connector in a direction 100 by means of a conventional fixing device (not shown) such as screws. The contacting section 533 of each contact 5 abuts against the contact pad 77 of the CPU package 7 thereby constituting a transmitting path from the contact pad 77 of the CPU package 7 to the contact pad 99 of the printed circuit board 9 via the contact 5.

When the contacting section 533 of the contact 5 is urged by the CPU package 7, the upper beam 51 will be twisted for a predetermined angle (comparing the numeral 51 in FIG. 7 and FIG. 6) and the first curved section 531 will deform which together provide a tension to force the contacting section 533 to abut against the contact pad 77 of the CPU package 7. When the upper beam 51 is twisted, the side plates 52 and the inner wall of the lateral narrow hole 602 provide support for the twist of the upper beam 51. The lower beam 55 will not be affected when the upper beam 51 is twisted because the support of the side plates 52.

Figure 8:
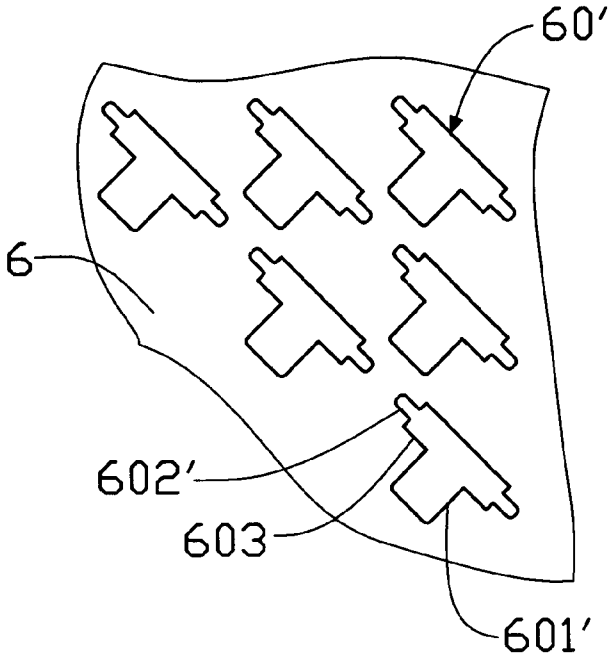
FIG. 8 is a second embodiment of the passageways taken from a top view.
Figure 10:
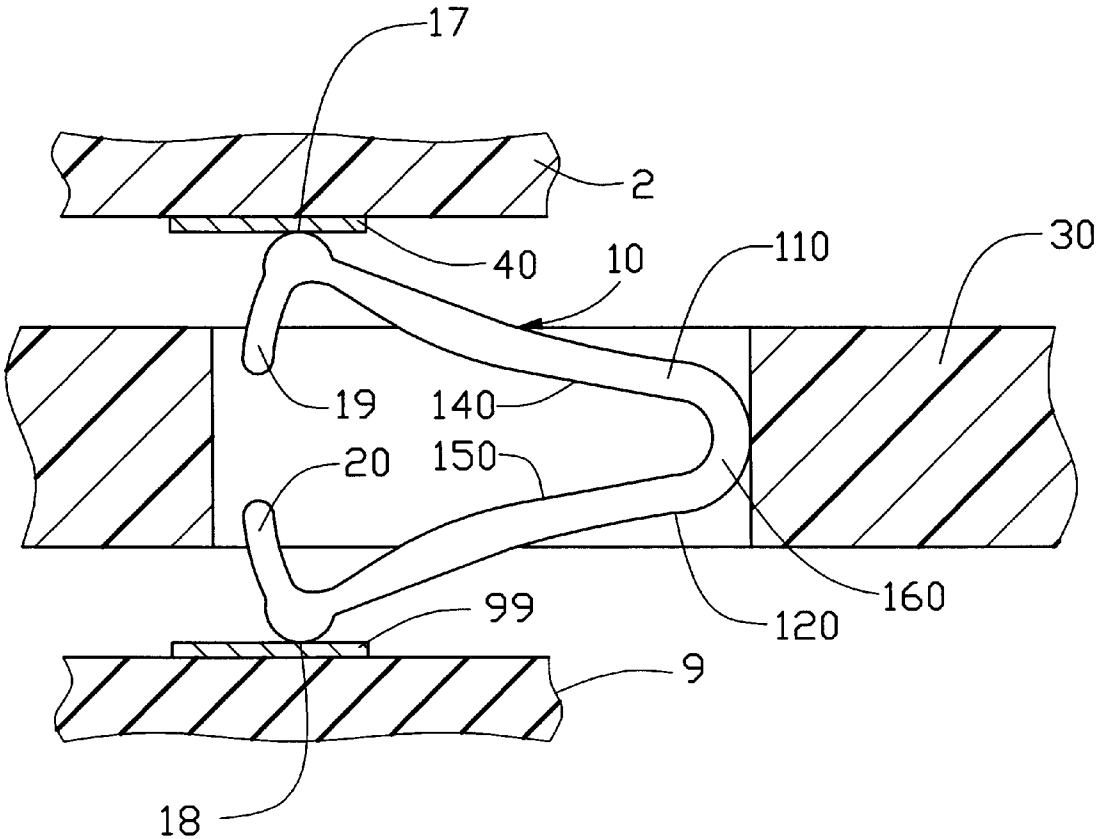
FIG.10 (PRIOR ART)
FIG. 10 is a schematic view of a conventional contact received in an LGA connector and sandwiched between an IC package and a printed circuit board.

The shape of the passageway 60 may be varied from that shown in FIG. 3. FIG. 8 illustrates a second embodiment of a passageway 60' which includes a longitudinal wide hole 601' and a lateral narrow hole 602' substantially perpendicular to the longitudinal wide hole 601'. Similar to previous embodiment, the engagement plates 52 of each contact 5 is retained in the lateral narrow hole 602' and the upper spring arm 53 is deformable in the longitudinal wide hole 601'. An intermediate hole 603 which is wider than the lateral hole 602' and communicated between the longitudinal wide hole 601' and the lateral narrow hole 602' is used for providing enough space for rotation of the upper beam 51 of the contact 5.

Figure 9:
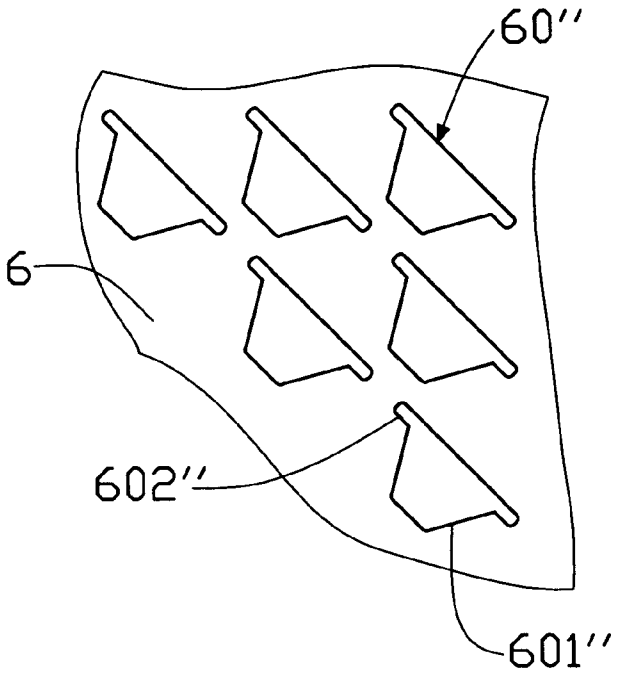
FIG. 9 is a third embodiment of the passageways taken from a top view.

The shape of the passageway 60 may also be varied from that shown in FIG. 8. FIG. 9 illustrates a third embodiment of a passageway 60" which includes a longitudinal wide hole 601" and a lateral narrow hole 602" communicating with the longitudinal wide hole 601". The engagement plate 52 of each contact 5 is engaged within the lateral narrow hole 602" and the upper beam 51 of the contact 5 is rotatably received in the longitudinal wide hole 601".

It is noted that, similar to the copending application Ser. No. 09/374,145 filed Aug. 12, 1999, the application discloses a contact 5 which includes a torsion beam 51 with an integrally extending spring arm 53 having a contact section 533 at the distal end thereof wherein the downward displacement of the contact section 533 includes two components of which, one is derived from self-deflection of the spring arm 53 due to the bending moment of the spring arm 53, while the other is initiated by downward rotation of the joint section or curved section 531 of the spring arm 53 and the torsion barm 51 due to torsion of the torsion beam 51. It is understood that in both applications, the relatively larger displacement of the contact section 533 is required to generate the sufficient engagement force against the circuit pad, and such a force can not be provided by only deflection of the spring arm without yield/fatigue. This is the reason why a torsion arm 51 is involved therein to provide a torsion which may rotate the root/joint portion 531 of the spring arm 53 to have the distal contact section 533 downward displaced a bit.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A contact comprising an upper beam and a lower beam both of which are connected by two side plates at two ends thereof, an upper spring arm extending from the upper beam, a lower spring arm extending from the lower beam, the upper spring arm having a contacting section substantially located at a highest position of the contact, the lower spring arm having a soldering tail substantially located at a lowest position of the contact, wherein when the side plates and the soldering tail are fixed in position and the contacting section of the upper spring arm is urged by an external force, the upper beam will be twisted for a predetermined angle to transmit a tension to the contacting section.

2. The contact as claimed in claim 1, wherein at least one of the side plates has a straight edge, a tapered edge connected to the straight edge and diverged downward.

3. The contact as claimed in claim 2, wherein the at least one side plate has a barb formed at one end of the tapered edge thereof.

4. The contact as claimed in claim 1, wherein the upper spring arm has a first curved section extending from the upper beam, a straight section connected between the first curved section and the contacting section.

5. The contact as claimed in claim 1, wherein the lower spring arm has a second curved section extending from the lower beam, a second straight section connected between the second curved section and the soldering tail.

6. A contact comprising an upper beam, two side plates connected to two ends of the upper beam, a lower beam connected to at least one of the side plates and spaced away from the upper beam, an upper spring arm extending from the upper beam, a lower spring arm extending from the lower beam, the upper spring arm having a contacting section substantially located at a highest position of the contact, the lower spring arm having a soldering tail substantially located at a lowest position of the contact, wherein when the side plates and the soldering tail are fixed in position and the contacting section of the upper spring arm is urged by an external force, the upper beam will be twisted for a predetermined angle to transmit a tension to the contacting section via the upper spring arm.

7. A land grid array connector comprising an insulative housing having a plurality of passageways defined therein, each passageway having a longitudinal wide hole and a lateral narrow hole communicating with and perpendicular to the longitudinal wide hole;

a plurality of contacts each of which is received in one of the passageways and each contact comprising an upper beam and a lower beam both of which are connected by two side plates at two ends thereof, an upper spring arm extending from the upper beam, a lower spring arm extending from the lower beam, the upper spring arm having a contacting section substantially located at a highest position of the contact, the lower spring arm having a soldering tail substantially located at a lowest position of the contact, wherein the side plates are firmly fixed in the lateral narrow hole, the soldering tail exposes to external from the longitudinal wide hole for being surface mounted to an external printed circuit board, and the contacting section extends out of the longitudinal wide hole.

8. The land grid array connector as claimed in claim 7, wherein at least one of the side plates has a straight edge, a tapered edge connected to the straight edge and diverged downward for bottom loading into the passageway.

9. The land grid array connector as claimed in claim 8, wherein the at least one side plate has a barb formed at one end of the tapered edge thereof for firmly engaging within the passageway.

10. The land grid array connector as claimed in claim 7, wherein the upper spring arm has a first curved section extending from the upper beam, a straight section connected between the first curved section and the contacting section.

11. The land grid array connector as claimed in claim 7, wherein the lower spring arm has a second curved section extending from the lower beam, a second straight section connected between the second curved section and the soldering tail.

12. A land grid array connector comprising an insulative housing having a plurality of passageways defined therein, each passageway having a longitudinal wide hole and a lateral narrow hole communicating with and perpendicular to the longitudinal wide hole;

a plurality of contacts each of which is received in one of the passageways and each contact comprising an upper beam, two side plates connected to two ends of the upper beam, a lower beam connected to at least one of the side plates and spaced away from the upper beam, an upper spring arm extending from the upper beam, a lower spring arm extending from the lower beam, the upper spring arm having a contacting section substantially located at a highest position of the contact, the lower spring arm having a soldering tail substantially located at a lowest position of the contact, wherein the side plates are firmly fixed in the lateral narrow hole, the soldering tail exposes to external from the longitudinal wide hole for being surface mounted to an external printed circuit board, and the contacting section extends out of the longitudinal wide hole.

13. A connector assembly comprising:

an insulative housing defining a plurality of passageways extending vertically therethrough;

a plurality of contacts respectively received within the corresponding passageways, each of said contacts including:

a torsion beam including at least one end fixed in position with regard to the housing;

a spring arm extending from the torsion beam with a contact section at a distal end opposite to an joint portion of the spring arm and the torsion beam, said contact section protruding out of a top surface of the housing;

an electrical package positioned atop the housing and downward pressing against the contact section; wherein downward displacement of said contact section is derived from both self-deflection of the spring arm due to a bending moment about the joint portion, and downward rotation of the joint portion due to a torsion generated by the torsion beam.

14. The connector assembly as claimed in claim 13, wherein said contact includes a fixing plate latchably engaged with the housing, and said end of the torsion beam is connected thereto.

15. The connector assembly as claimed in claim 14, wherein the contact further includes a solder tail section connecting to a portion extending from said fixing plate while spatially segregated from said torsion beam so as not to be influenced by the displacement of the contact section of the contact.

* * * * *